US005988023A

United States Patent [19]

Townsend et al.

[11] Patent Number: 5,988,023

[45] **Date of Patent: *Nov. 23, 1999**

[54] SLOTTED PIN ENGAGING TOOL

[75] Inventors: Donley Townsend, Detroit; Richard N. Charland, New Baltimore, both of Mich.

[73] Assignee: Chrysler Corporation, Auburn Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/689,123

[22] Filed: Jul. 30, 1996

[51] Int. Cl.[6] ..... B25B 13/32

[52] U.S. Cl. ..... 81/90.2; 81/114; 81/443; 81/448; 279/107

[58] Field of Search ..... 81/442–444, 448–449, 81/452–455, 90.1–90.3, 90.9, 91.3, 92, 94, 98–99, 111–115, 176.3; 279/35, 37, 43, 50, 74, 107

[56] References Cited

U.S. PATENT DOCUMENTS

| | | | |
|---|---|---|---|
| 216,776 | 6/1879 | Backus | 81/114 |
| 412,535 | 10/1889 | Parker | 81/114 X |
| 494,631 | 4/1893 | Fleurant | 81/115 X |
| 789,679 | 5/1905 | Turnbull | 279/37 |
| 978,208 | 12/1910 | Reilly | 81/113 |
| 1,786,701 | 12/1930 | Butlin | 81/114 X |
| 2,277,026 | 3/1942 | Saucedo | 81/114 |
| 2,381,597 | 8/1945 | Johnson | 81/111 X |
| 2,704,954 | 3/1955 | Martorella | 81/112 |
| 3,339,439 | 9/1967 | Van Dalen et al. | 81/112 |
| 3,377,893 | 4/1968 | Shorb | 81/113 |
| 3,750,500 | 8/1973 | Peterson | 81/52.35 |
| 3,862,516 | 1/1975 | Broscoff et al. | 51/217 P |
| 4,374,481 | 2/1983 | Brodie | 81/115 |
| 4,513,643 | 4/1985 | McKean | 81/53.2 |
| 4,590,826 | 5/1986 | McKean | 81/53.2 |
| 4,741,229 | 5/1988 | Rachanski et al. | 81/53.2 |
| 4,940,370 | 7/1990 | Gipson | 408/72 R |
| 4,982,625 | 1/1991 | Bonner | 81/53.2 |
| 5,270,084 | 12/1993 | Parker | 428/34 |
| 5,277,084 | 1/1994 | Weber et al. | 81/53.2 |
| 5,461,946 | 10/1995 | Nutt | 81/53.2 |
| 5,492,039 | 2/1996 | Haikal et al. | 81/53.2 |

FOREIGN PATENT DOCUMENTS

| | | | |
|---|---|---|---|
| 0137827 | 9/1979 | Germany | 279/37 |

*Primary Examiner*—D. S. Meislin
*Attorney, Agent, or Firm*—James R. Yee

[57] ABSTRACT

An apparatus for engaging a slotted pin comprising a cylindrical member defining a cylindrical axial pin bore and two tab slots spaced 180° apart, the slots for a portion of their length connecting through the member to the bore, engaging tabs pivotally connected in the tab slots, means for biasing the tab members outwardly from the tab slots, and means for causing engagement of the tabs with the slots of a slotted pin inserted into the bore.

8 Claims, 3 Drawing Sheets

SLOTTED PIN ENGAGING TOOL

BACKGROUND OF THE INVENTION

1. Field of the Invention

The present invention relates to an apparatus used for installing and removing slotted pins and, more particularly, to a tool for engaging the slots of a slotted pin.

2. Description of the Related Art

Slotted pins are used in heavy industrial applications such as manufacturing booms to connect various components. Such pins typically are removed and installed via two flat slots located near the end of the pin. These slots conventionally are manipulated with an open-ended wrench engaging the flat slots, which is an inefficient and time-consuming process because the spacing of the pins generally allows limited pin rotation on each application of wrench to pin.

SUMMARY OF THE INVENTION

Accordingly, it is an object of the present invention to provide a slotted pin engaging tool that allows easy installation and removal of a slotted pin. It is a further object of the present invention to provide a slotted pin engaging tool that can be used in a variety of applications, that maintains a firm hold of the pin that is to be removed or installed, and that is easily removed when installation or disassembly is complete. It is yet another object of the present invention to provide a slotted pin engaging tool that is readily used in constrained locations.

For that reason, disclosed and claimed herein is an apparatus for engaging a slotted pin comprising a cylindrical member defining a cylindrical axial pin bore, the cylindrical member further comprising two tab slots spaced 180° apart, the slots for a portion of their length connecting through the member to the bore. The present invention further comprises engaging tabs pivotally connected to the member proximate the ends of the tab slots and biasing the tab members outwardly from the tab slots. The present invention further comprises means for causing engagement of the tabs with the slots of a slotted pin inserted into the bore, which in the preferred embodiment is an annular ring slidably disposed around the cylindrical member which is slid down over the tabs to force them into the tab slots to engage the slots of the slotted pin.

Also disclosed is an embodiment of the present invention which comprises means for retaining the annular ring in place in the form of a retaining tab in a retaining slot defined by the cylindrical member. The retaining tab is pivotally connected proximate one end of the tab slot and is biased outwardly by retaining biasing means. When the ring is slid past the retaining tab, the tab pivots outwardly and the ring is held in place.

The details of the present invention, both as to its structure and operation, can best be understood in reference to the accompanying drawings, in which like reference numerals refer to like parts and in which:

DETAILED DESCRIPTION OF THE INVENTION

Figure 1:
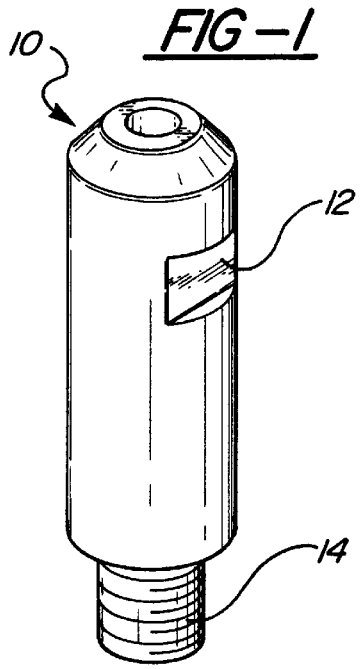
FIG. 1 is a perspective view of a conventional slotted pin.
Figure 2:
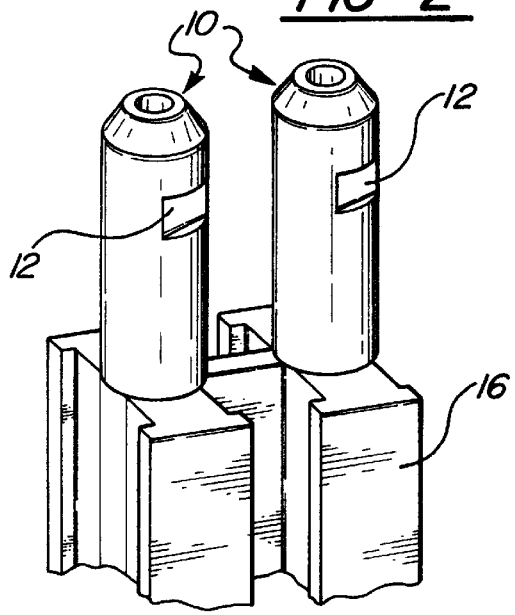
FIG. 2 is a perspective view of conventional slotted pins installed on a boom.
Figure 3:
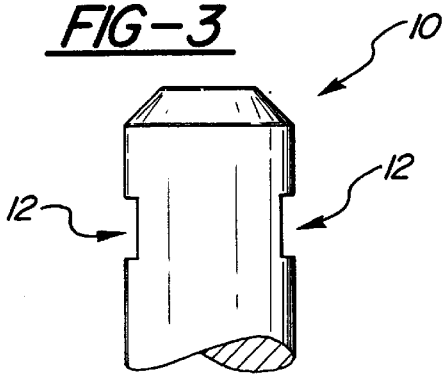
FIG. 3 is a side view of a conventional slotted pin.

Turning first to FIG. 1, FIG. 2, and FIG. 3, conventional slotted pins with which the apparatus of the present invention is used are shown. Slotted pins 10, which are used to connect various components in manufacturing processes, such as connecting components to boom 16, comprise slots 12 and threads 14. Slots 12 are shaped to be engaged by an open ended crescent wrench. As shown in FIG. 2, such pins often are located close together, making manipulation of the slots with a crescent wrench difficult and requiring continued removal and replacement of the crescent wrench on the slots as the wrench is rotated. The apparatus of the present invention solves this problem.

Turning to FIG. 4 through FIG. 11, the apparatus of the present invention is shown.

Figure 4:
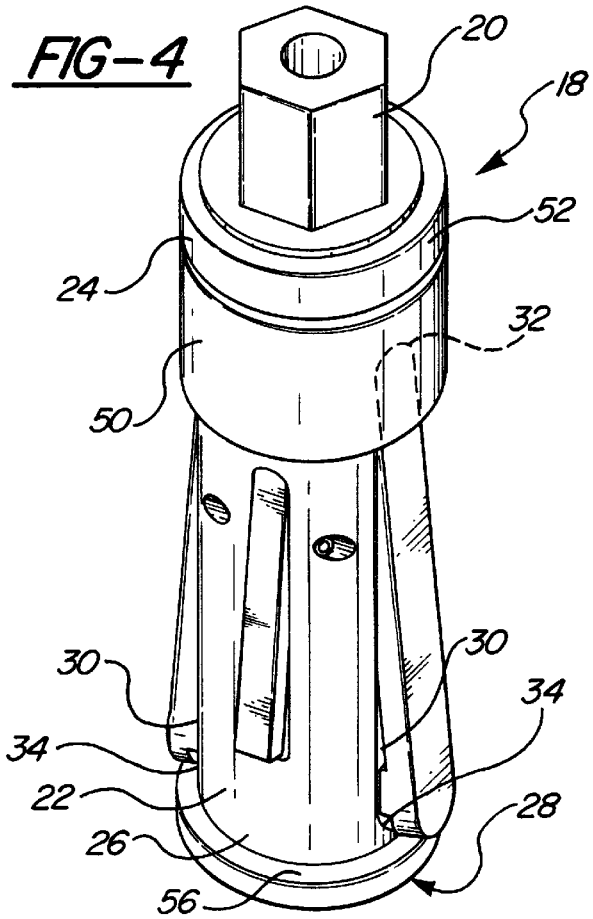
FIG. 4 is a perspective view of the apparatus of the present invention in the open position.
Figure 5:
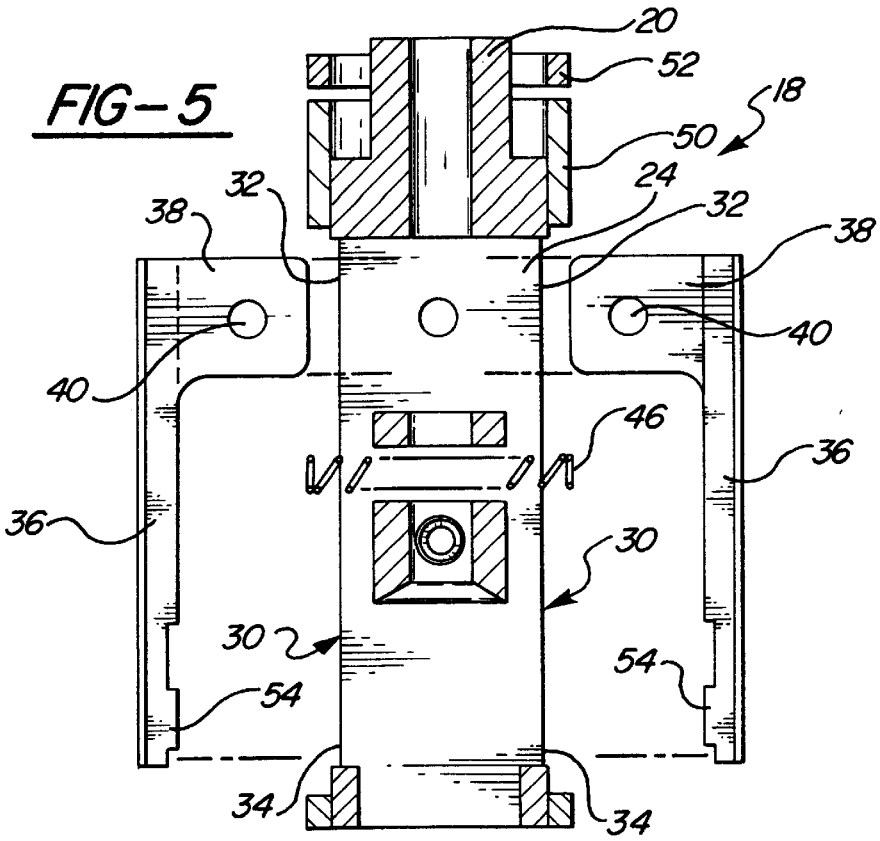
FIG. 5 is an exploded view of the apparatus of the present invention.

Turning first to FIG. 4 and FIG. 5, slotted pin engaging tool 18 is shown. Tool 18 comprises wrench engaging means 20 which in the preferred embodiment comprises a hexagonal shaped head which can be engaged by a crescent wrench or a socket wrench for rotation. In another embodiment (not shown) of the present invention, a handle is permanently connected to tool 18, instead of the embodiment shown, which is a separate tool for use with a crescent or socket wrench. Tool 18 further comprises cylindrical member 22 having first end 24 and second end 26. Cylindrical member 22 defines a cylindrical axial pin bore 28 commencing at second end 26 and proceeding approximately one third of the way into the length of the member (see FIG. 8) for engagement with a slotted pin and defines tabs slots 30, which in the preferred embodiment are generally rectangular slots which for a portion of their length pass through member 22 and open into bore 28. Slots 30 have first ends 32 and second ends 34 and receive engaging tabs 36. Tabs 36 are pivotally connected in slots 30 proximate first ends 32 and are normally biased outward from the slots via biasing means, as shown in FIG. 4. In the preferred embodiment tabs 30 further comprise shoulders 38 which define holes 40. The tabs are pivotally connected to cylindrical member 22 via pivot bolt 42 (see FIG. 6) which passes through pivot bolt hole 44 defined by cylindrical member 22 and holes 40 of shoulders 38. In the preferred embodiment the biasing means comprises biasing spring 46 which is retained by spring bore 48 defined by member 22 perpendicular to slots 30. Tool 18 further comprises means for causing engagement of tabs 36, which in the preferred embodiment comprises annular ring 50 which is slidably disposed about member 22.

Figure 6:
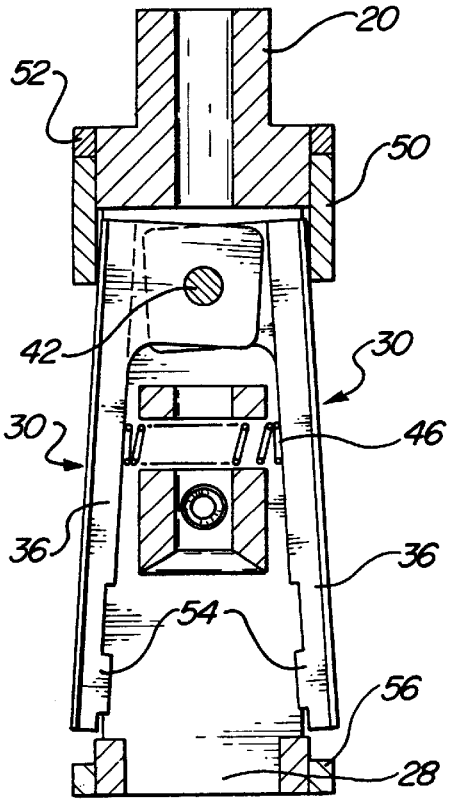
FIG. 6 is a cut-away view of the apparatus of the present invention in the open position.
Figure 7:
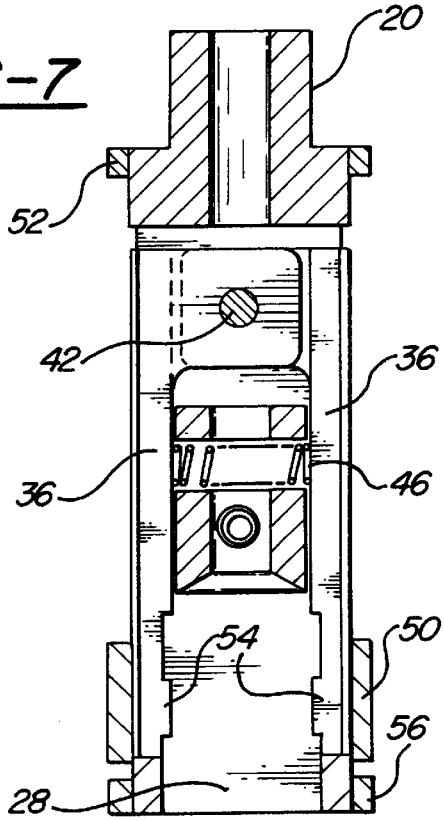
FIG. 7 is a cut-away view of the apparatus of the present invention in the working position.

Turning to FIG. 6 and FIG. 7, tool 18 is shown in the open and working positions, respectively. In the open position, spring 46 pushes outwardly against tabs 36 so that they pivot around bolt 46 via shoulders 38 and to extend outwardly from slots 30. In the open position ring 50 is fully raised so that it abuts annular shoulder 52. In the open position tabs 36 project outwardly, clear from bore 28 to allow bore 28 to be placed over the end of a slotted pin. To engage the pin, ring 50 is slid downwardly over member 22 to force tabs 36 inwardly, compressing spring 46, into slots 30. The fit between the ring and the member is tight enough to prevent unrestricted motion of the ring but loose enough to allow the ring to be slid downwardly and upwardly without significant effort. As the tabs are forced inwardly ridges 54 project into bore 28 and engage the slots of the pin. Ring 50 holds the tabs in the working position. Annular collar 56 prevents ring 50 from sliding off the end of member 22. In the working position, the pin slots are engaged with sufficient force to allow removal or installation of the pin by rotation of the tool, via either its integral handle or by a wrench engaging the wrench engaging means.

Figure 8:
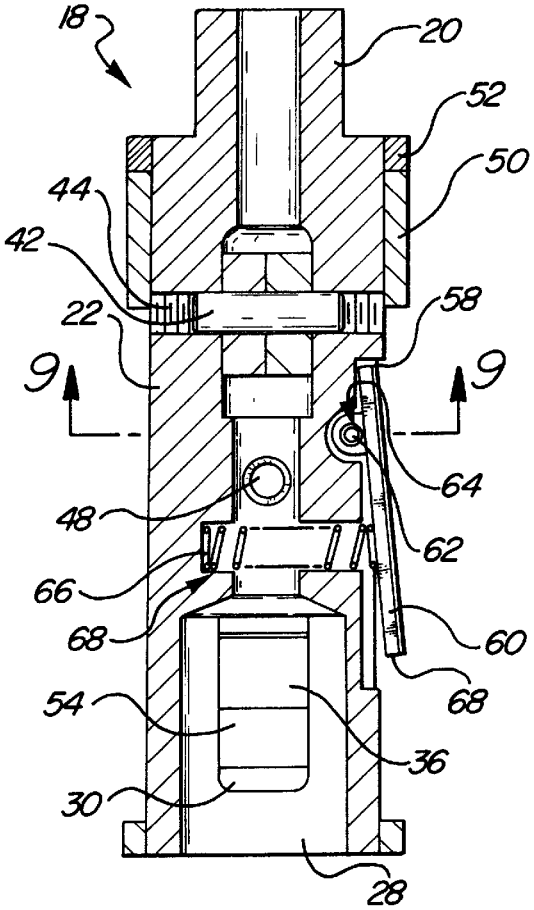
FIG. 8 is a cut-away view of the apparatus of the present invention showing the retaining tab.
Figure 9:
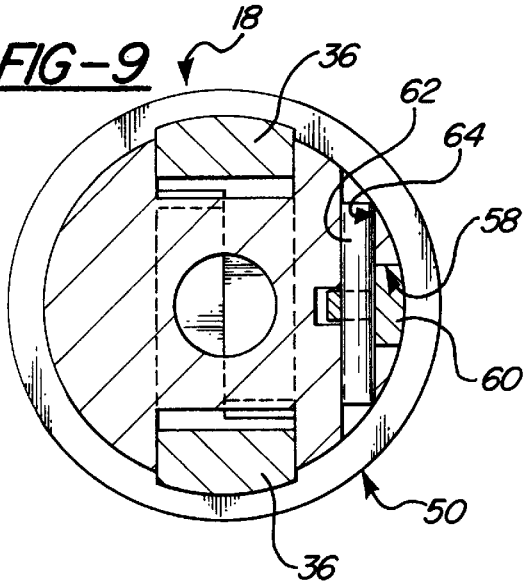
FIG. 9 is a top view of the apparatus of the present invention along line 9—9 of FIG. 8.

Turning to FIG. 8 and FIG. 9, another feature of the present invention is shown. As is shown, tool 18 can further comprise means for retaining ring 50 in place, that is, to prevent it from moving upward and allowing the tabs to move from the working position. The retaining means in the preferred embodiment comprises retaining slot 58 defined by member 22 between and parallel to the tab slots. Retaining tab 60 is pivotally connected proximate one end of retaining slot 58, in the preferred embodiment via retaining pivot bolt 62 located in retaining pivot bolt hole 64. Retaining tab 60 is normally biased outwardly via biasing means, the biasing means in the preferred embodiment comprising retaining biasing spring 66 located in retaining biasing spring bore 68. In operation, as ring 50 is moved downwardly over member 22, tab 60 is pushed inwardly against spring 66 into slot 58 (see FIG. 9). As ring 50 moves past the end 68 of tab 60, spring 66 pushes tab 60 outwardly such that its projection prevents ring 50 from moving upwardly (see FIG. 10). The only way to move ring 50 upwardly to allow tabs 36 to disengage is for the operator to push tab 60 inwardly against spring 66 and move ring 50 past tab 60. Tab 60 thus prevents disengagement of the present invention without positive operator action. This feature desirably is, but need not be, present with the other features of the present invention.

Figure 10:
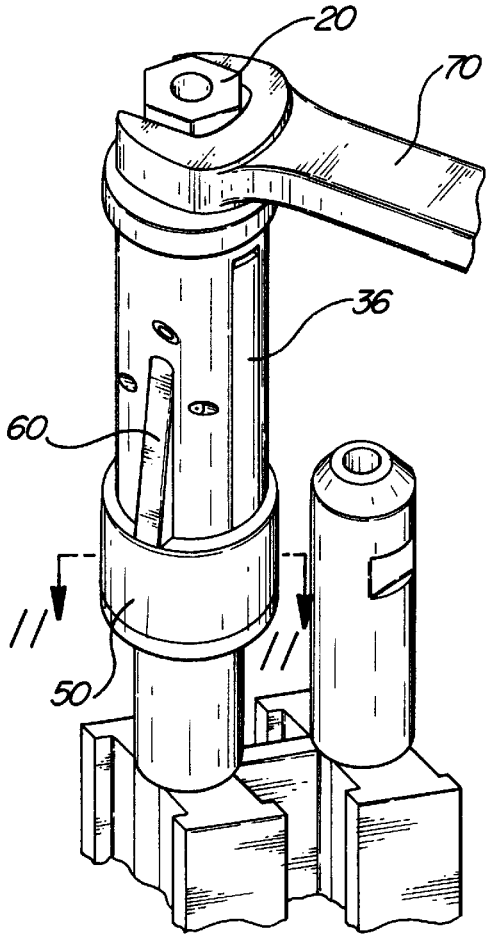
FIG. 10 is a perspective view of an embodiment of the apparatus of the present invention engaged by a crescent wrench.
Figure 11:
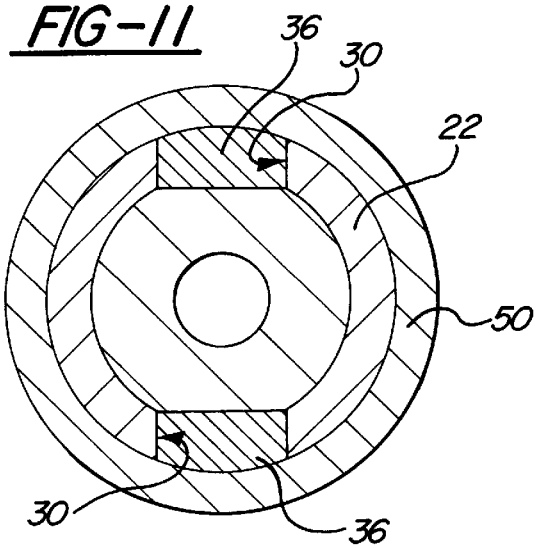
FIG. 11 is a cut-away view of the apparatus of the present invention along line 11—11 of FIG. 10.

Turning to FIG. 10 and FIG. 11, the apparatus of the present invention is shown in the working position engaging the slots of a slotted pin. Crescent wrench engages wrench engaging means 20 to manipulate the pin. Ring 50 is held in place by tab 60, and tabs 36 engage the slots of the slotted pin.

The present invention has been described in an illustrative manner. It is to be understood that the terminology which has been used is intended to be in the nature of words of description rather than limitation. Many modifications and variations of the present invention are possible in light of the above teachings. Therefore, within the scope of the appended claims, the present invention may be practiced other than as specifically described.

What is claimed is:

1. In combination with a slotted pin having first and second slots both defined by a flat surface, an apparatus for engaging the slotted pin comprising:

a tool engaging portion;

a cylindrical member having an upper end and a lower end, said tool engaging portion connected to said upper end, said cylindrical member defining a cylindrical bore at said lower end;

first and second engaging tabs each having a distal portion adapted to engage one of said flat surfaces, said first and second engaging tabs being pivotally connected to said cylindrical member proximate said upper end of said cylindrical member, both of said first and second engaging tabs movable between an outward position for allowing the slotted pin to enter and exit said cylindrical bore and an inward position for non-rotatably engaging the slotted pin;

a biasing member for biasing said engaging tab members to said outward position; and a sleeve surrounding said cylindrical member and being linearly slidable therealong between an upper position and a lower position, said sleeve operative to move said first and second engaging tabs to their second positions when in said lower position.

2. The apparatus for engaging a slotted pin of claim 1, wherein said biasing member comprises a biasing spring and a spring bore defined by said cylindrical member, said spring retained in said spring bore.

3. The apparatus for engaging a slotted pin of claim 2, further comprising a retaining tab carried by said cylindrical member for selectively retaining said sleeve in said lower position.

4. The apparatus for engaging a slotted pin of claim 3, wherein said retaining tab is pivotally mounted to said cylindrical member.

5. In combination with a slotted pin having first and second slots both defined by a flat surface, an apparatus for engaging the slotted pin comprising:

a tool engaging portion;

a cylindrical member having an upper end and a lower end, said tool engaging portion connected to said upper end, said cylindrical member defining a bore which is open at said lower end;

first and second engaging tabs pivotally connected to said cylindrical member proximate said upper end of said cylindrical member, both of said first and second engaging tabs movable between an outward position for allowing the slotted pin to enter and exit said cylindrical bore and an inward position for engaging the slotted pin;

a biasing member for biasing said engaging tab members to said outward position;

a sleeve surrounding said cylindrical member and being translatable therealong between an upper position and a lower position, said sleeve operative to move said first and second engaging tabs to said inward position when in said lower position; and a retaining arm for selectively retaining said sleeve in said lower position, said retaining arm including a first end pivotally attached to said cylindrical member and a second end outwardly biased to radially extend beyond said sleeve when said sleeve is in said lower position.

6. The apparatus for engaging a slotted pin of claim 5, wherein said engaging tabs are adapted to non-rotatably engage the slotted pin when in said inward position.

7. The apparatus for engaging a slotted pin of claim 5, wherein said sleeve is linearly translatable along said cylindrical member between said upper position and said lower position.

8. The apparatus for engaging a slotted pin of claim 5, wherein said biasing member comprises a biasing spring and a spring bore defined by said cylindrical member, said spring retained in said spring bore.

* * * * *